US005392546A

United States Patent [19]

Bailey

[11] Patent Number: 5,392,546

[45] Date of Patent: Feb. 28, 1995

[54] MANUALLY CHANGEABLE DISPLAYS

[75] Inventor: William M. Bailey, Cedarburg, Wis.

[73] Assignee: Everbrite, Inc., Greenfeld, Wis.

[21] Appl. No.: 997,903

[22] Filed: Dec. 29, 1992

[51] Int. Cl.[6] ..... G09F 3/04

[52] U.S. Cl. ..... 40/450; 40/447; 40/492

[58] Field of Search ..... 40/446, 447, 448, 449, 40/450, 451, 452, 492; 116/DIG. 3

[56] References Cited

U.S. PATENT DOCUMENTS

| | | | |
|---|---|---|---|
| 3,296,726 | 1/1967 | Hill | 40/446 |
| 3,363,347 | 1/1968 | Benson | 40/446 |
| 3,372,501 | 3/1968 | Greene | 40/450 |
| 4,115,936 | 9/1978 | Nidelkoff | 40/446 |
| 4,220,948 | 9/1980 | Trame | 40/446 |
| 4,509,279 | 4/1985 | Greenberger | 40/450 |
| 4,539,768 | 9/1985 | Halliday | 40/447 |
| 4,729,184 | 3/1988 | Cihanek | 40/446 |
| 4,777,747 | 10/1988 | Murray, Jr. | 40/450 |
| 4,858,357 | 8/1989 | Thorn | 40/450 |

*Primary Examiner*—Clifford D. Crowder

*Assistant Examiner*—Larry D. Worrell, Jr.

*Attorney, Agent, or Firm*—Ryan, Kees & Hohenfeldt

[57] ABSTRACT

Two thin sheets of material have slits to define coplanar flaps that are configured and arranged in conformity with segments of a segmental display such as a seven-segment digital display. The layers are superimposed such that corresponding segments are superimposed. The layers have contrasting colors. Applying a force against the overlying flap in a segment causes the overlying and underlying flaps to deflect in the same direction for the outer edges of the flaps to pass each other. When the force is removed the flaps restore to positions that are substantially coplanar with the layers in which they are formed. When the flap in the overlying layer is coplanar with its layer that flap and, hence, the segment is not visible because there is no contrast between the flap and the layer being viewed. When the flap of the underlying layer is caused to switch over the flap in the overlying layer there is contrast between the flap and the overlying layer so the segment represented by the flap is visible.

20 Claims, 4 Drawing Sheets

MANUALLY CHANGEABLE DISPLAYS

BACKGROUND OF THE INVENTION

The invention disclosed herein pertains to segmented displays arranged to depict seven-segment digits, letters of the alphabet and symbols and wherein the segments can be made selectively visible or invisible to effectuate having the same display adaptable to represent any digit from 0–9 and any letters of the alphabet, for example.

The basic concept of a display device which may have its segments easily changed by hand in order to display the numerals 0–9 is known. Displays of this type are useful where changes must be made relatively frequently in numbers or letters such as in signs that display prices or other alphanumeric values.

SUMMARY OF THE INVENTION

A digital display according to the present invention comprises a planar first layer and a viewable second layer overlaying the first layer. The layers are composed of a material that deflects or bends when a force is applied and is self-restoring to undeflected condition when the force is removed. The layers each have slits defining flaps configured and arranged in a pattern representing the segments of a seven-segment digit or other characters or symbols. The flaps constituting a segment are superimposed and subject to being deflected so that one passes the other in response to a manual force being applied. Passing of the flaps causes the underlying flap to become the overlying flap. One flap for each segment in the second or overlaying layer has the same color as the area surrounding said flap in the second layer. This makes the flap on top, and hence, the particular segment invisible by reason of there being no contrast between the flap or segment and the surrounding area. When the overlying flaps and underlying flaps are switched so that the underlying flap which contrasts with the background or second overlaying layer is on top, the segment represented by the flap becomes visible because of the contrast between it and the background color of the overlaying second layer.

The invention is exemplified herein by showing and describing several versions of seven-segment digital or numerical displays. It should be understood, however, that the principles elucidated in connection with describing seven-segment digits are equally applicable to displays that represent letters of the alphabet or other characters or symbols. Letters of the alphabet, for example, simply require use of more segments to represent them and make them readable. Accordingly, in the ensuing specification, the term "seven-segment digital display" shall be construed as being replaceable and exchangeable with "multiple-segment alphabetic character" or other symbol and in the claims the term "segmented display" is used as the generic expression for digital displays, numeric displays and other characters and symbols that are defined by segments arranged in a predetermined pattern.

An objective of the invention is to provide a segmented display such as a seven-segment digital display or alphabetic display wherein any of the segments may be switched to a visible or invisible state to convert from one digit or letter to another by simply applying a force to them manually and wherein the segments remain in a stable state until a force is applied again.

Another objective of the invention is to provide a display that does not have parts which could be easily deformed, separated or lost from the sign in which the display is used.

Still another objective is to provide a display wherein the changeable segments lie substantially in the same planes so that it appears to an observer that the display is printed or otherwise formed on a single layer.

A further objective is to provide manually changeable displays that can be implemented with a variety of materials to provide for making the segments visible with back lighting and face lighting.

How the foregoing and other more specific objectives of the invention are achieved will be evident in the ensuing description of illustrative embodiments of the invention which will now be set forth in reference to the accompanying drawings.

DESCRIPTION OF A PREFERRED EMBODIMENT

Figure 1:
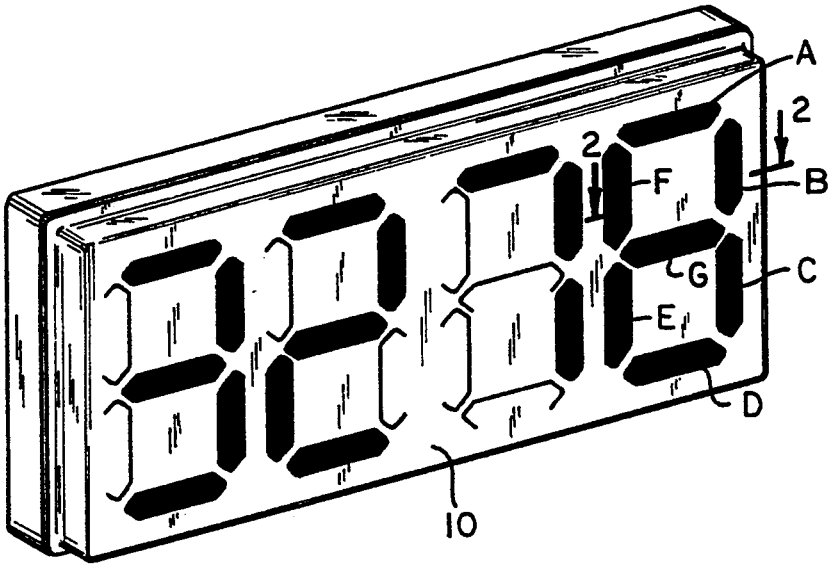
FIG. 1 is a perspective view of a sign that employs the new changeable segmented displays in the form of seven-segment digital displays.

Refer to FIG. 1 for an overview of the new display. In FIG. 1 the displays currently represent the digits 3278. The segments of the displays are designated in the conventional manner with letters A–G which have been applied only to the numeral 8 in FIG. 1. The segments included in the group A–G in any of the numerals are visible because they contrast with the background color of what is called herein, a second or overlying viewable planar layer 10. This layer is a thin sheet of plastic or other flexible material which has the property of restoring to a planar condition after having been deflected by a manual force which is subsequently discontinued. As will be explained later, the visible segments A–G in the numeral 8, for example, are flaps that are developed in a first planar layer that has the bending or deflecting properties of the second layer 10 but underlies the upper or second layer 10 which is visible to the viewer. Any of the segment flaps are deflectable against their contrasting mate to bring about disappearance or appearance of the segment. For example, the segments F and E are not visible in the numeral 3 of FIG. 1 because they are coplanar with layer 10 and are not contrasting with layer 10. As will be explained, by applying a manual force to any of the flaps constituting a digit segment, whether it is invisible or visible, results in the opposite effect.

Figure 2:
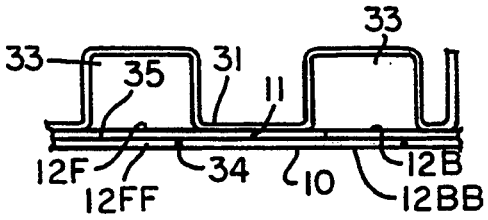
FIG. 2 is a partial transverse section of a digital display taken on the line corresponding with 2—2 in FIG. 1.
Figure 3:
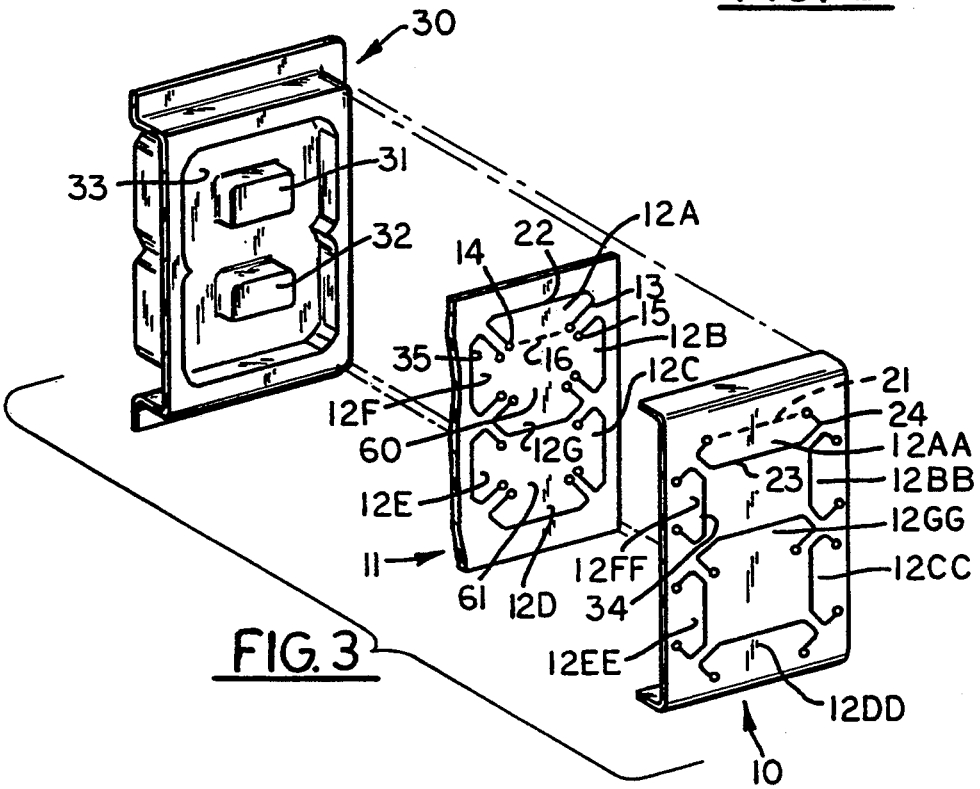
FIG. 3 is an exploded view of one embodiment of the digital display.

Attention is now invited to FIG. 3 which depicts the components of one of the digital displays constructed in accordance with the invention. The planar first or underlying layer comprising a digit is designated generally by the numeral 11. Flaps constituting segments of a digit are stamped or die cut in the layer. For example, flaps such as the one marked 12A, are defined by slits such as the one marked 13. Typical slit 13 terminates desirably in holes 14 and 15 which facilitates bending or deflecting the flap. A dashed line 16 extending between holes 14 and 15 represent the imaginary hinge line on which the flaps deflect out of the plane of layer 11 when a force is applied to them. When the deflecting force is removed, of course, because of the inherent characteristics of the layer 11 material, the flaps self-restore to coplanar condition with first layer 11. Another layer, generally designated by the numeral 10 overlays or is superimposed on first layer 11 as is evident in FIGS. 2 and 3. By way of example and not limitation, the layers may be acrylic, polyvinyl chloride, polyethyleneterphthalate, polyethylene, polycarbonate, polyester, polystyrene, polypropylene, Mylar, plastic coated paper, acetate resins and the like. Returning to FIG. 3, one may see that second layer 10 is also slitted to define flaps configured and arranged in a pattern representing the segments of a seven segment digit. In the second or overlying layer 10, the flaps are designated 12AA to 12GG. A flap 12AA, for example, in layer 10 is superimposed on a flap 12A in the underlying first layer 11. Typical flap 12AA in second layer 10 deflects or bends along an imaginary line such as the dashed line marked 21. Typical flap 12A in first layer 11, as previously indicated, bends along a dashed imaginary line marked 16 and has an outer edge 22. Superimposed flap 12AA in second layer 20 has an outer edge 23. Note that as the layers 11 and 20 are oriented in FIG. 3, flap 12A in layer 11 extends from its hinge or bending line 16 upwardly to terminate in edge 22. On the other hand, the mating flap 12AA in second layer 10 extends downwardly from its hinge line 21 to terminate in an edge 23. It will be evident that all of the flaps 12AA–12GG in second layer 10 have their hinge lines superimposed on the outer edges of the flaps in first layer 11. As a consequence, when superimposed flaps are deflected concurrently, the flaps can pass each other so that the flap which was originally coplanar with the second or overlying layer 20 becomes underlying and hidden while the flap that was underlying shifts to the top and becomes substantially coplanar with the second layer. If the top flap is the one that contrasts with the top or overlying layer then the segment represented by the flap is visible.

The superimposed flaps may be mounted on a holder or support such as the one generally designated by the numeral 30 in FIG. 3. The support 30 may be formed of a plastic or other lightweight material. If the displays are only front lighted, the support 30 can be opaque. If the displays are back lighted, the support can be translucent, or transparent. There are two raised areas in the form of hollow pads 31 and 32 formed in the support body 30 in FIG. 3. The central non-bending zones 60 and 61 surrounded by flaps 12A, 12B, 12G and 12F, for example, or their counterparts 12AA, 12BB, 12GG and 12FF, respectively, in the other layer of the flap containing layers can be adhered to each other and to the faces of pads 31 and 32 to prevent the layers 11 and 10 from shifting and to provide for the structural integrity of the centers of the FIG. 3 configuration.

In FIG. 2, the outer or free edge of a typical flap 12FF in second layer 10 is marked 34 as it is in FIG. 3. The outer edge of typical mating flap 12F in first layer 11 is marked 35 as it is in FIG. 3.

Figure 4:
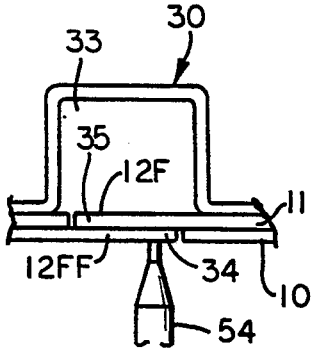
FIGS. 4, 5 and 6 show a cross-section of one of the segments of the display and illustrate how, by applying a force manually, a segment in a display can be made visible or invisible.
Figure 5:
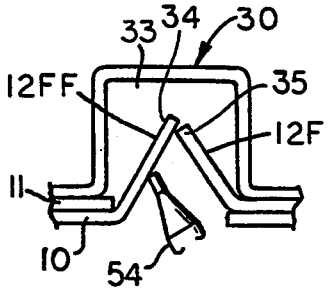
Figure 6:
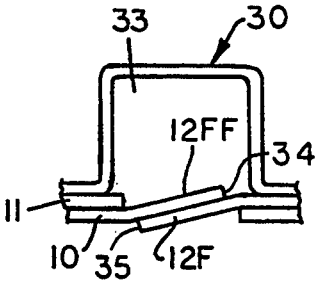

Attention is now invited to FIGS. 4–6 which will be used to illustrate how a segment of the new segmented display can be converted from a visible to an invisible state. In FIG. 4, the first layer 11 contains the flap 12F of a typical segment. The outer or free edge of flap 12F is marked 35. The second or overlying layer 10 has flap 12FF formed in it. The outer or free edge of flap 12FF is marked 34. Assume, for the sake of illustration, that layer 10 is opaque and black and the underlying layer 11 is white. Under the conditions existing in FIG. 4, flap 12FF would be substantially invisible or not discernible as a segment because it is black and black does not contrast with the surrounding black area of second layer 10. Flap 12F, on the other hand, is white. Now, in order to make the segment visible, it is only necessary to press directly against the exposed flap with one's finger or an instrument such as a pencil 54. In FIG. 5, that operation has been carried out to the extent of having the outer end 34 of black flap 12FF pass the outer end 35 of what was formerly the concealed white flap 12F. In FIG. 6, the force applied to the flaps has been discontinued and white flap 12F has become exposed for viewing as one of the segments of the digital display. Thus, the segment defined by white flap 12F has become visible because it has a color that contrasts with the color of layer 10. The superimposed layers 11 and 10 are thinner in actual embodiments than they appear to be in the drawings. In an actual embodiment, the layers are on the order of 0.005 to 0.015 inch thick, depending on the scale of the digit display. Layers of polyvinyl chloride, polypropylene, polystyrene, polyethyleneterephthalate, polycarbonate, polyester and Mylar of about this thickness can be used by way of example and not limitation. In FIG. 6 it appears that the flaps 12F and 12FF are noticeably angulated and are not substantially coplanar with their surroundings. However, in an actual embodiment, because of the thinness of the layers, the visible flaps appear to be fully coplanar with the contrasting surrounding area on the foremost or viewable layer 10.

Figure 7:
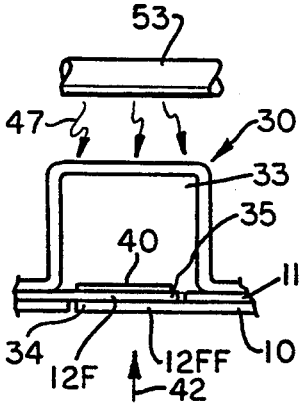
FIGS. 7, 8 and 9 are vertical sections through modified versions of the display and are used to represent different back lighted versions of the new display, one version of which uses polarizing layers to make segments of the display visible and invisible.
Figure 8:
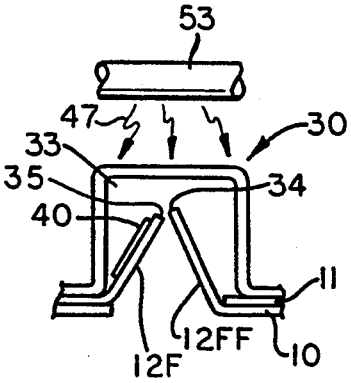
Figure 9:
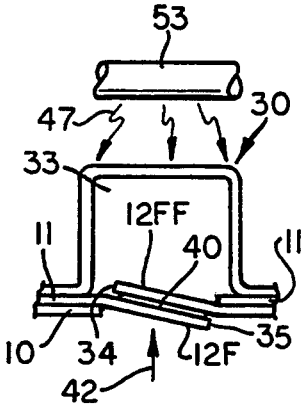

FIGS. 7–9 are used to demonstrate two different back lighted versions of the displays. These versions are both designed to make the selected exposed segments of the digital display visible and illuminated in an otherwise dark ambient. In respect to one version, items that are structurally similar to those in the previously discussed embodiments are given the same reference numerals even though they may be composed of a different material in the later discussed version.

In the first version of the invention to be discussed (of the two versions represented by same FIGS. 7–9), the so called first layer 11 is comprised of a material known by the trade name LISA (light intensifying sheet acrylic). This material or its equivalent has the property of appearing to fluoresce or to act as a light pipe when it is edge lighted or exposed to a beam of light directed at any angle including perpendicularity to its surface. LISA is available in a variety of colors. The flap 12F which is die-cut in the layer 11 mentioned above is composed of the material LISA. The free edge of LISA flap 12F is marked 35 in FIG. 7. Layer 10 is opaque and may be black or any color that contrasts with the color of the LISA. The free edge of flap 12FF in layer 10 is marked 34. Intimately bonded to the rear or inside of typical LISA flap 12F is a layer 40 which is primarily a light reflector. This thin layer 40 may simply be printed white or it can be a thin film of white plastic material or paper such as a decal. Flaps 12F and 12FF are positioned over channel 33 of support 30. Even though light is projected from tubular light source 53 onto the backside of layer 11 in FIG. 7, no lighted segment is presently visible from the front because the overlaying layer 10 is, for illustration purposes, black and opaque. Thus, when opaque layer 10 is viewed in the direction of the arrow 42, the flap 12FF formed in layer 10 will not be discernible as a segment because there will be no contrast between the flap and the surrounding area of layer 10.

The mounting or support member 30 in FIG. 7 may be transparent or translucent. In FIG. 8, flap 12F, composed of LISA material, has been manually deflected along with the flap 12FF. The outer edge 35 of flap 12F has passed under flap 12FF in FIG. 8. Thus, when the force that is causing deflection of the flaps 12F and 12FF is removed as is the case in FIG. 9, flap 12F, by reason of its inherent springiness, restores to substantially coplanar position and flap 12FF comes down upon it. At this time reflective layer 40 is between opaque flap 12FF and fluorescent LISA flap 12F. With the opaque flap 12FF behind the reflector layer 40 and the fluorescent LISA layer 12F, the fluorescent layer becomes visible to one looking at it in the direction of the arrow 42 because flap 12F is illuminated by light directed from light source 53 at layer 11. The part of flap 12F that is under reflector 40 lights up because LISA fluoresces and acts somewhat like a light pipe, even though light rays impinge only to the sides of the opaque reflector 40.

The next version of the display to be discussed using FIGS. 7–9 and the same reference numerals for the same elements even though different materials are used compared to the version just discussed. This version is also suitable for back lighting in that the illuminated segments can be seen in a dark ambient. In FIG. 7, layers 11 and 10 are thin films that are polarized orthogonally relative to each other. For example, layer 11 and flap 12F therein may be considered to have zero degrees of polarization and layer 10 and flap 12FF therein may be polarized at 90° relative to layer 11. Layer 11 has intimately bonded to it a thin layer 40 of a depolarizer or birefringent material. A birefringent material 40, as is known, is a material that separates a light ray into two unequally refracted, plane polarized rays having orthogonal polarizations. This occurs in crystalline materials in which the velocity of light rays is not the same in all directions. It is also called double refraction material. The birefringent material used may be an acetate. It has been found that a white tissue paper is also reasonably effective as a depolarizer which may be used in place of the birefringent film 40. When the layers 10, 11 and depolarizer or birefringent layer 40 are arranged as they appear in FIGS. 7, and 8, no light would be visible to a viewer looking in the direction of the arrow 42 if a light beam were projected toward the back of birefringent layer 40 in the direction of the arrow marked 47 because of the orthogonal polarization of flaps 12F and 12FF. When, as in FIG. 9, the flap 12F is deflected so as to be on the opposite side of flap 12FF as compared with FIGS. 7 or 8, the depolarizing or birefringent layer 40 becomes interposed between flaps 12FF and 12F. Since the birefringent layer 40 rotates or depolarizes light passing through flap 12FF, the light will also pass through flap 12F. Thus, a light beam from source 53 would be seen to illuminate flap 12F to a viewer looking in the direction of the arrow 42 toward flap 12F which, of course, constitutes a visible flap in a segment of the seven-segment display.

Figure 10:
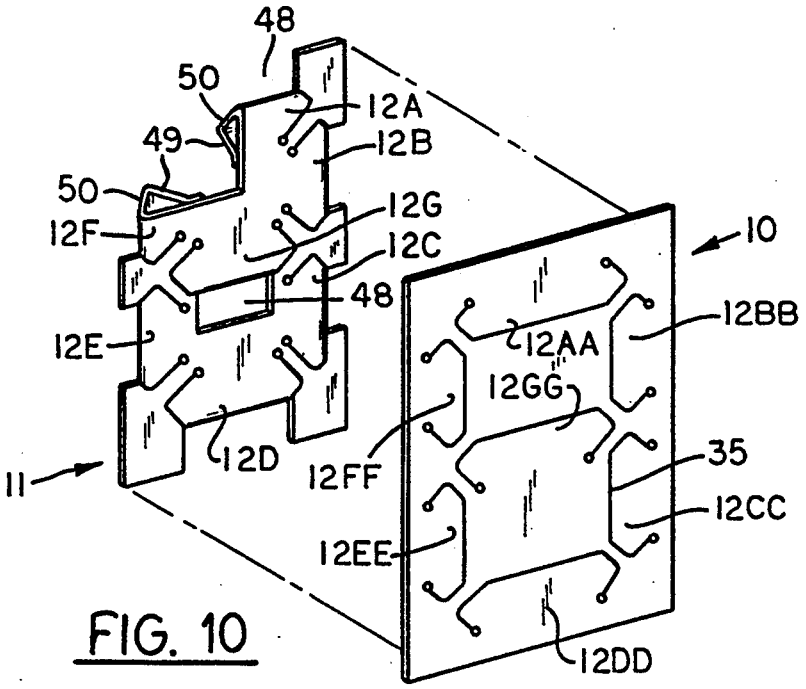
FIG. 10 illustrates another alternative form of the display for back lighting.
Figure 11:
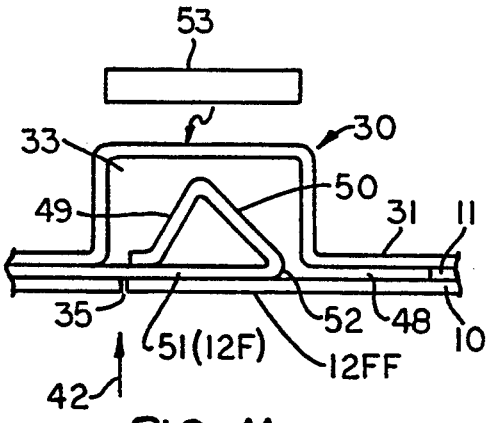
FIGS. 11 and 12 are sections through the display of FIG. 10 that show how one of the segments can be converted from a visible state to an invisible state and vice versa.
Figure 12:
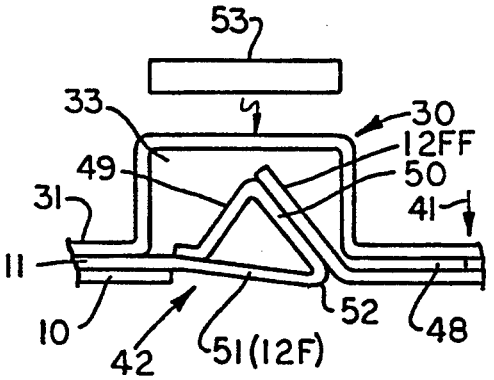

Another version of the new segmented display is depicted in FIGS. 10–12. This embodiment is also capable of being visualized in a dark ambient by reason of it being subjected to back lighting. Referring to FIG. 11, the second or overlying layer plastic sheet 10 may be considered to be black or opaque. It has the flaps 12AA to 12GG stamped or die-cut in it. The underlying layer 11 has the seven-segments 12A–12G but they are more complex in construction than those heretofore discussed as will be evident in reference to FIGS. 11 and 12.

In FIG. 11, for example, a typical flap 12FF in the overlying layer 10 is opaque so that if it were viewed in the direction of the arrow 42 there would be no visualization of a segment of the display because the flap 12FF is black and opaque as is the adjoining area of layer 10. The outer edge of flap 12FF in FIG. 11 is marked 35 as it is in previously discussed embodiments. The underlying typical corresponding flap, such as flap 12F derived from layer 11, has a triangular configuration as evident in FIG. 11. The flap may be made up from a single piece of translucent white plastic material, for example. There is a gap 48 between support layer 30 and layer 20 due to the die-cut in layer 11 being bent into a triangle having three sides 49, 50 and 51. Side 51 in FIG. 11 is shown with opaque flap 12FF overlying it. Under the conditions prevailing in FIG. 11, an observer looking at flap 12FF does not observe a segment because there is no contrast between flap 12FF and the surrounding area of opaque layer 10. In other words, light beams emitted by light source 53 would not penetrate through the opaque flap 12FF.

In FIG. 12, however, the opaque flap 12FF has been manually deflected so as to pass the outboard tip 52 of triangular flap 12F. As shown, when manual pressure is released, flap 12FF remains in an angled open position, resting on the side 50 of flap 12F. Since flap 12F is translucent and appears white, the segment will be visible by reason of a light from source beam 53 being directed through it as indicated. As in the preceding figures, the thickness of the layers is exaggerated to facilitate drawing and viewing them. Thus, it appears that the bottom layer 51 of flap 12F is deflected rather than essentially coplanar with the adjacent layer 10 as compared with the perception one gets by looking at an actual embodiment of the display wherein it looks like portion 51 is coplanar with layer 10.

Figure 13:
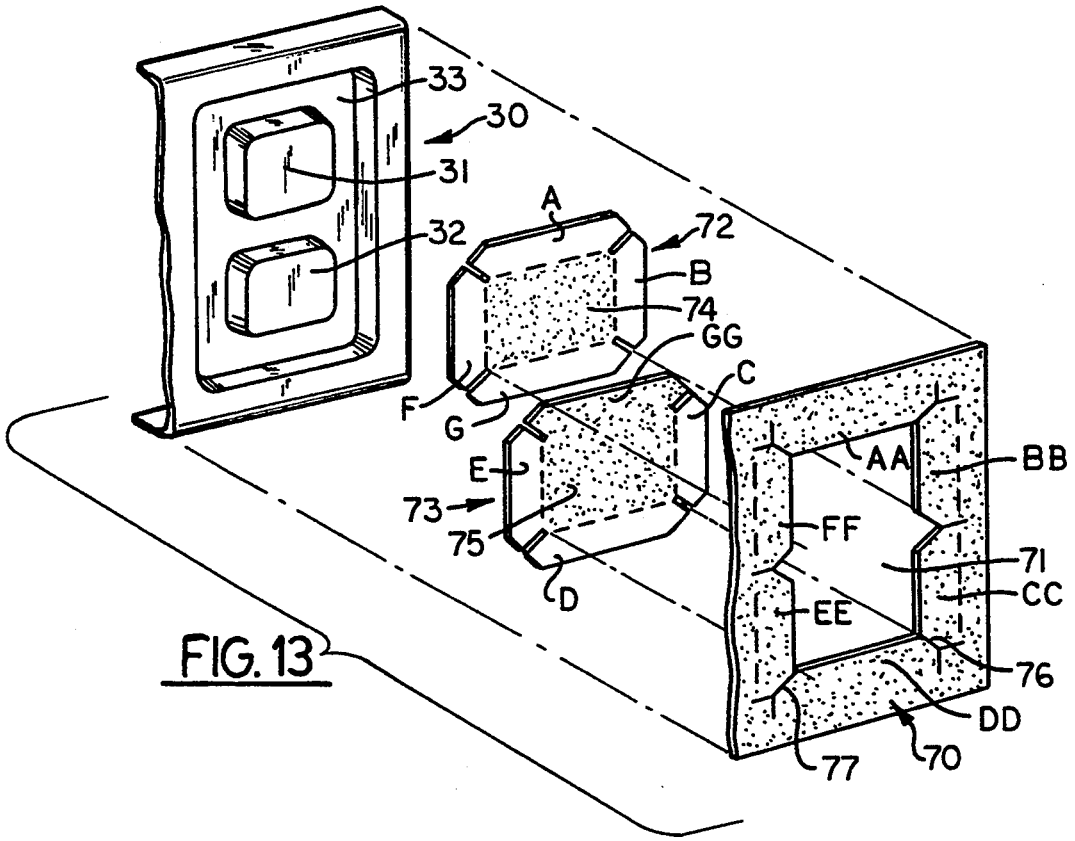
FIG. 13 is an exploded perspective view of another alternative embodiment of the display.

Refer now to FIG. 13. In this embodiment, the overlying layer 70 has die-cut flaps AA to FF and an opening 71. Layer 70 is opaque, although it may be colored as well as black. The underlying layer is made in two parts 72 and 73. The parts 72 and 73 have central areas 74 and 75, respectively, which are opaque and of the same color as overlying layer 70. Underlying layer part 72 has slitted deflectable flaps marked A, B, G and F on it. These flaps may be white or some light color that contrasts with the color of central area 74 and overlying layer 70. Underlying layer part 73 has deflectable flaps C, D, E and GG. Flap GG has the same color as central area 75 and overlying layer 70. The fold lines of the flaps are imaginary and indicated with dashed lines.

The support 30 for a display is similar to previously described supports, so it and its parts are given the same reference numbers. Assembly of the FIG. 13 display involves adhering the central region 74 of part 72 to riser pad 31, adhering the central region 75 of part 73 to riser pad 32 of the support 30, and adhering the rim of overlying layer 70 to the rim of the support 30. The result is an assembly wherein at the outset flap AA overlies flap A, flap BB overlies B, flap CC overlies C, and so forth. The central areas 74 and 75 of parts 72 and 73 are presented in the opening 71 of overlying layer or sheet 71. The central areas 74 and 75 have a color that matches the background color of opaque overlying layer 70. Flap GG is opaque and has the same color as central region 75. The flaps are defined by slits such those marked 76 and 77.

The flap segments can be printed on or unprinted as required for contrast. Printing may be done in a press or by silk screening or color may be imparted by applying decals. The FIG. 13 design lends itself to the use of LISA and polarizing materials as in the FIGS. 7–9 embodiment or to loop-shaped flaps as in the FIGS. 10–12 embodiment. The appearance is improved because the segments touch and are separated only by the slits. This makes small digits possible.

The principles of the various embodiments or versions of the segments described herein can be applied to dot matrix displays, not shown. Especially in very large displays it is advantageous to break up what would otherwise be very long and wide segments into smaller segments characterized as dots. A plurality of dots used in place of one segment provides greater flexibility as to patterns that can develop which is especially desirable when the displays are for complicated configurations. The changeable segments described herein may, for example, be used to create the well known 5×7 dot matrix displays.

Although several illustrative embodiments of the new seven-segment changeable display have been described in substantial detail, such description is to be considered illustrative rather than limiting, for the invention may be variously embodied and is to be limited only by the claims which follow.

I claim:

1. A manually changeable seven-segment digital display, comprising:

a planar first underlying layer and a viewable planar second layer overlaying the first underlying layer, the layers being composed of a material that deflects in response to an applied force and that restores to undeflected condition when the force is removed, said layers containing flaps configured and arranged in a pattern defining the seven segments of the digital display, a flap constituting a segment in the second layer being superimposed on a corresponding flap constituting the segment in the first layer, the superimposed flaps in the layers comprising one segment of the display, at least the flaps in each layer having contrasting colors, said flaps each joined to the layer in which it is defined along a bending line and each extending away from its bending line and terminating in an edge, a flap constituting a segment in the first layer extending along its plane away from the bending line oppositely of the direction in which the flap constituting the corresponding flap in the second layer extends from its bending line, whereby applying a force alternately to the superimposed flaps causes said flaps to deflect for the edge of one flap to pass the edge of the other and whereby removing the force restores the flaps to undeflected condition so that the formerly overlying flap becomes the underlying flap to provide for alternately displaying flaps of segments that respectively contrast in color and do not contrast with the second layer to thereby make the segment visible or not visible, respectively.

2. The display according to claim 1 wherein said first and second layers are selected from the group of materials consisting of polystyrene, polypropylene, polyethylene, polyethyleneterephthalate, acrylic, polyvinyl chloride, polycarbonate, polyester, acetate resins and plastic coated paper.

3. The display according to claim 1 including a layer of reflective material bonded to a flap in the underlying layer on the one of its surfaces that is most remote from the surface of the cooperating flap in the overlying layer for the same segment of the display.

4. The display according to claim 1 wherein said underlying first layer is composed of light intensifying sheet acrylic (LISA) and said overlaying second layer has a color that contrasts with the color of the LISA and is non-light transmissive.

5. The display according to claim 4 wherein said overlaying second layer is opaque.

6. The display according to claim 1 wherein said underlying first layer and overlying second layer have flaps for a digit composed respectively of materials that are polarized in directions 90° apart from each other, and including a layer of birefringent or depolarizing material mounted to the flap in one layer to provide for alternately positioning the birefringent or depolarizing material layer between said flaps of polarized material to turn the polarization direction of the light passing through a flap in one layer to illuminate and make the flap in the other layer visible and for positioning the flaps so the birefringent or depolarizing material is not between them to prevent said illumination.

7. The display according to claim 6 wherein said birefringent material is an acetate.

8. The display according to claim 1 wherein the flap in the underlying layer for a segment is in the form of a loop of the material of the underlying layer.

9. The display according to claim 1 wherein the flap in the underlying layer for a segment is formed as a loop comprising a light transmitting material for the loop to support a flap comprised of contrasting material in the overlying layer for the segment, said loop supporting said flap in the overlying layer at an angle relative to said layer to provide for light to pass through at least a portion of said loop to illuminate the segment to be visualized, said loop also being deflectable to a position behind said contrasting flap in the overlying layer for making said flap invisible for lack of contrast with the overlying layer.

10. A manually changeable segmented display, comprising:

a planar first underlying layer and a viewable planar second layer overlaying the first underlying layer, the layers being composed of a material that deflects in response to an applied force and that restores to undeflected condition when the force is removed, said layers containing flaps configured and arranged in a pattern defining the segments of the display, a flap constituting a segment in the second layer being superimposed on a corresponding flap constituting the segment in the first layer, at least the flaps in each layer having contrasting colors, said flaps each joined to the layer in which the flaps are defined along a bending line and terminating in an edge, the flaps constituting the respective segments in the first layer extending along the plane of the layer away from the bending line oppositely of the direction in which the flaps constituting the corresponding segments in the second layer extend from their bending lines, a support member having areas surrounded by channels, said layers having zones that are surrounded by the flaps of the segmented display and said zones are mounted to said areas with the flaps constituting respective segments overlying said channels to provide for deflecting said flaps, whereby applying a force alternately to the superimposed flaps constituting a segment causes said flaps to deflect into a channel for the edge of one flap to pass the edge of the other and whereby removing the force restores the flaps to undeflected condition so that the formerly overlying flap becomes the underlying flap.

11. The display according to any one of claims 1, 2, 3, 4, 5, 6, 7, 8 or 9 wherein said segments are arranged in a 5×7 dot matrix pattern.

12. A manually changeable segmented display, comprising:

a support member including spaced apart pads having coplanar support surfaces, an underlying layer comprised of two thin, separate parts each of which is composed of a material that deflects in response to an applied force and restores to undeflected condition when the force is removed, said parts having a generally rectangular shape, including a central region and slits extending from their margins for defining four deflectable flaps arranged about the central region with the flaps on one part designated flaps (A), (B), (G) and (F) and flaps on the other part designated as flaps (C)<(D)<(E) and (GG), said flaps each joined to the layer part in which they are defined, along a bending line and each extending away from its bending line and terminating in an edge, the central regions of the layer parts are bonded to said support surfaces of the pads such that a flap (G) on one layer part and a flap (GG) on the other layer part are superimposed one over the other and all flaps are arranged in a pattern defining the segments of the display, an overlying thin layer having marginal areas bonded to said support and composed of a material that deflects in response to an applied force and restores to undeflected condition when the force is removed, said layer having a central rectangular opening with slits extending from the inside edges to define flaps that extend from the edge to a bending line, said flaps designated as flaps (AA), (BB), (CC), (DD), (EE)< and (FF) that are superimposed, respectively on said flaps (A), (B), (C), (D), (E), and (F), whereby applying a force alternately to the superimposed flaps of a segment causes said flaps to deflect for the edge of one flap to pass the edge of the other and whereby removing the force restores the flaps to undeflected condition so that the formerly overlying flap becomes the underlying flap to provide for alternately displaying flaps of segments that contrast and do not contrast in color with said overlying layer to thereby make the flaps alternately visible and not visible.

13. The display according to claim 12 wherein said first and second layers are selected from the group of materials consisting of polystyrene, polypropylene, polyethylene, polyethyleneterephthalate, acrylic, polyvinyl chloride, polycarbonate, polyester, acetate resins and plastic coated paper.

14. The display according to claim 12 including a layer of reflective material bonded to a flap in the underlying layer on the one of its surfaces that is most remote from the surface of the cooperating flap in the overlying layer for the same segment of the display.

15. The display according to claim 12 wherein said underlying first layer is composed of light intensifying sheet acrylic (LISA) and said overlaying second layer has a color that contrasts with the color of the LISA and is non-light transmissive.

16. The display according to claim 15 wherein said overlaying second layer is opaque.

17. The display according to claim 12 wherein said underlying layer and overlying layer have flaps for a display composed respectively of polarized materials that are polarized in directions 90° apart from each other, and including a layer of birefringent or depolarizing material mounted to the flap in one layer to provide for alternately positioning the birefringent or depolarizing material layer between said flaps of polarized material to turn the polarization direction of the light passing through a flap in one layer to illuminate and make the flap in the other layer visible and for positioning the flaps so the birefringent or depolarizing material is not between them to prevent said illumination.

18. The display according to claim 17 wherein said birefringent material is an acetate.

19. The display according to claim 12 wherein the flap in the underlying layer for a segment is in the form of a loop of the material of the underlying layer.

20. The display according to claim 12 wherein the flap in the underlying layer for a segment is formed as a loop comprising a light transmitting material for the loop to support a flap comprised of contrasting material in the overlying layer for the segment, said loop supporting said flap in the overlying layer at an angle relative to said layer to provide for light to pass through at least a portion of said loop to illuminate the segment to be visualized, said loop also being deflectable to a position behind said contrasting flap in the overlying layer for making said flap invisible for lack of contrast with the overlying layer.

* * * * *